US006995974B1

(12) United States Patent
Rodriguez

(10) Patent No.: US 6,995,974 B1
(45) Date of Patent: Feb. 7, 2006

(54) FOLDABLE, STURDY, LIGHTWEIGHT MONITOR STAND FOR EASY PORTABILITY AND STORAGE

(75) Inventor: Ronald D. Rodriguez, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 208 days.

(21) Appl. No.: 10/687,946

(22) Filed: Oct. 17, 2003

(51) Int. Cl.
*H05K 5/00* (2006.01)

(52) U.S. Cl. ..... 361/679; 312/223.1

(58) Field of Classification Search ..... 361/679, 361/681, 724–727; 312/9.64, 31, 257.1, 312/258, 223.1–223.2, 31.02
See application file for complete search history.

(56) References Cited

U.S. PATENT DOCUMENTS 3,294,464 A * 12/1966 Lew ..... 312/258
3,576,355 A * 4/1971 Stone et al. ..... 312/258
5,664,854 A * 9/1997 Letch ..... 312/262
6,289,326 B1 9/2001 LaFleur

* cited by examiner

*Primary Examiner*—Yean-Hsi Chang
(74) *Attorney, Agent, or Firm*—Chareene A. Haley

(57) ABSTRACT

A foldable, sturdy, lightweight, monitor stand for portability, including: at least three walls, a plurality of support structures, and a top wall, each wall having a top section, bottom section, inner section, and outer section; at least three walls enclosing the plurality of support structures, at least one wall having an opening for a computer monitor; hinging each wall, each support structure, and top wall together to form a unitary structure permitting folding between the walls, support structures, and top wall to enclosing the support structures, at least two walls being non-hingedly attached, securing the support structures and top wall to a desired position on the inner section of the walls within the housing when the stand is assembled, securing brackets to the inner section of the walls; and securing the non-hingedly coupled walls together for complete assemblage of the stand and/or to secure any items within the assembled stand.

17 Claims, 4 Drawing Sheets

FOLDABLE, STURDY, LIGHTWEIGHT MONITOR STAND FOR EASY PORTABILITY AND STORAGE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates to apparatus for a foldable, portable, monitor stand that is sturdy enough to house a computer system, and more specifically, a lightweight monitor stand where its foldable walls having support structures (including shelves) that are also foldable for easy portability for military, commercial and recreational applications including, but not limited to, tradeshows, conferences, and conventions.

BACKGROUND OF THE INVENTION

The Kiosk was designed and developed to accommodate a need for a "stand alone unit" that houses an interactive computer monitor/touch screen display, for commercial trade shows and traveling exhibit applications. The requirements were to be lightweight, collapsible and shippable (UPS, FEDEX etc.) and yet maintain a "corporate" look. It was also required to have shelving for a CPU and CD/DVD player, keyboard, speakers for the audio aspect and a storage area for miscellaneous accessories. The kiosk also required that an operator be able to gain access to the equipment without completely disassembling the unit, so a locking door feature was incorporated into the present invention.

From the foregoing, it will be appreciated that there is a need in the art to develop a sturdy lightweight foldable monitor stand with foldable shelves for easy portability and storage. The present invention is directed to overcoming one, or more, of the problem set forth above.

SUMMARY OF THE INVENTION

The present invention relates to a foldable, sturdy, lightweight, multi-walled monitor stand for portability. The monitor stand includes: at least three walls, a plurality of support structures, and a top wall, each wall having a top section, bottom section, inner section, and outer section; at least three walls enclosing the plurality of support structures, wherein at least one wall having an opening for a computer monitor; hinging means for coupling (hinges) each wall, each support structure, and top wall together to form a unitary structure which permits folding between the walls, support structures, and top wall to form a housing enclosing the support structures, wherein at least two walls being non-hingedly attached, and a first means for securing the support structures and top wall to a desired position on the inner section of the walls within the housing when the stand is assembled, another means for securing being coupled to the inner section of the walls; and a second means for securing the non-hingedly coupled walls together for complete assemblage of the stand and/or to secure any items within the assembled stand.

Small casters allow the kiosk to be easily moved and relocated during the constantly changing tradeshow environment. Slight variations of the unit will allow for computer monitors of various sizes to be used without changing the kiosks overall dimensions. The casters are removable to allow for a semi permanent display, including a lobby or alcove. The present invention provides the apparatus to be setup from crate to freestanding in just minutes.

It is to be understood that the foregoing general description and the following detailed description are exemplary and explanatory only and are not to be viewed as being restrictive of the present invention, as claimed. These and other objects, features and advantages of the present invention will become apparent after a review of the following detailed description of the disclosed embodiments and the appended claims.

DETAILED DESCRIPTION OF THE EMBODIMENTS

Figure 1:
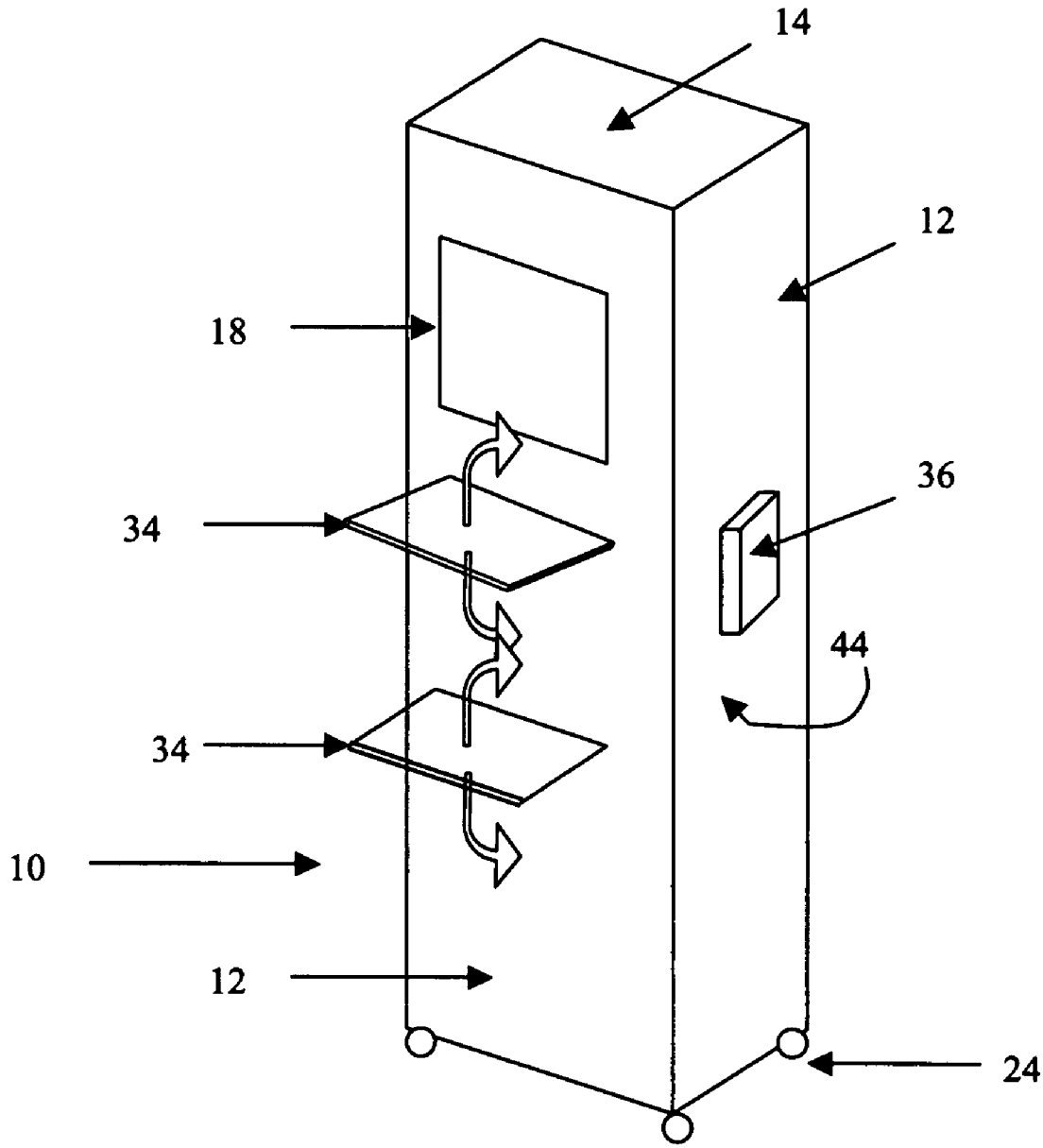
FIG. 1 is a perspective view illustrating the portable monitor stand in assembled form showing the outer shelve for various items including a keyboard and an accessible storage unit for holding consumer related items according to embodiments of the present invention.
Figure 2:
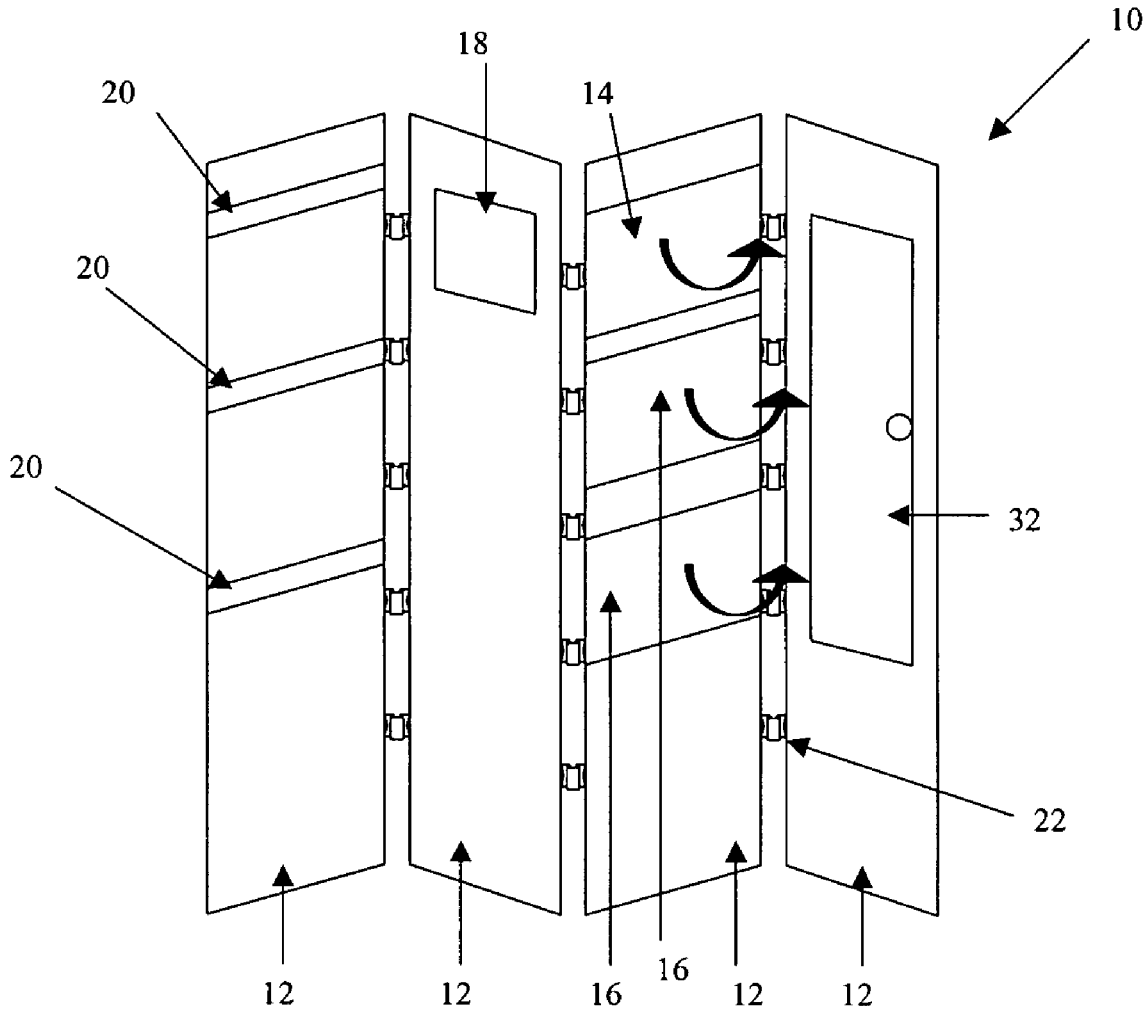
FIG. 2 is a perspective view illustrating the unassembled portable monitor stand shown as a unitary structure and the support structures and top wall in a folded, unassembled position according to embodiments of the present invention.
Figure 3:
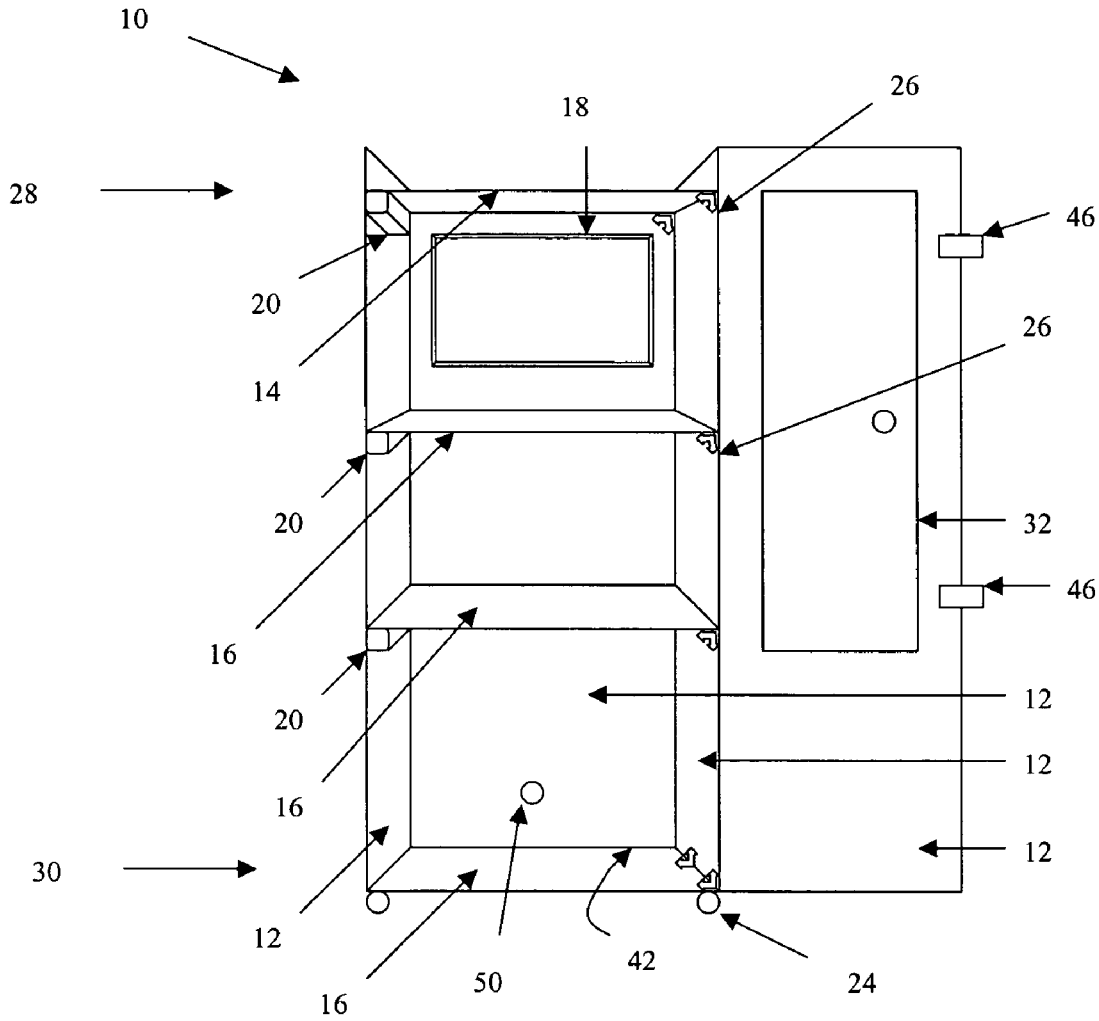
FIG. 3 is a perspective view illustrating the portable monitor stand in a partially assembled position with the support structures and top wall in assembled position according to embodiments the present invention
Figure 4:
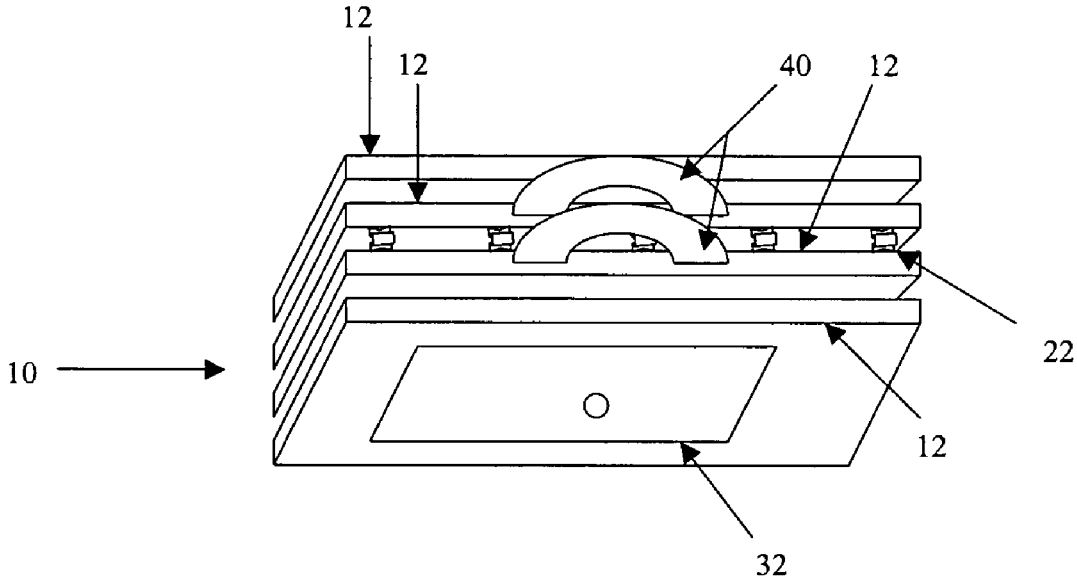
FIG. 4 is perspective view illustrating the portable monitor stand in a collapsed, portable unassembled position showing the handles according to the present invention.

The present invention relates to a foldable, sturdy, lightweight, multi-walled monitor stand for portability. FIGS. 1–4 illustrate embodiments of the monitor stand 10 which includes: at least three walls 12, a plurality of support structures 16, and a top wall 14, wherein each wall 12 includes a top section 28, bottom section 30, inner section 42, and outer section 44. At least three walls 12 enclose the plurality of support structures 16 and a top wall 14. At least one wall 12 includes an opening for a computer monitor 18.

At least one hinging means 22 and 26 is utilized for coupling each wall 12, each support structure 16, and top wall 14 together to form a unitary structure which permits folding between the walls 12, support structures 16, and top wall 14 and to form a housing enclosing the support structures 16. The hinging means 22 and 26 for coupling each wall 12, each support structure 16, and top wall 14 together includes single hinge(s) or double hinge(s). The unitary structure 10 is folded into a collapsible unassembled position for easy, convenient storage and portability, shown in FIG. 4.

There includes at least one first means for securing 20 the support structures 16 and top wall 14 to a desired position on the inner section 42 of the walls 12 within the housing when the stand 10 is assembled. The first means for securing 20 each support structure 16 and the top wall 14 include brackets. Each bracket is secured to the inner section 42 of the walls 12.

At least two walls 12 are non-hingedly attached. The second means 46 for securing the non-hingedly coupled walls 12 together for complete assemblage of the stand 10 including a locking means coupled to the outer section 44 of the non-hinged walls to secure any items within the assembled stand 10.

Each wall 12, top wall 14, and support structures 16 are constructed of a sturdy lightweight materials including, but not limited to aluminum, plastic, and aluminum plastic laminate. In other embodiments, the monitor stand 10 includes support structures 16 being foldable shelves. The support structures 16 are dimensioned and configured to accommodate the inclusion of at least one of a monitor, interactive touch screen monitor, CPU, keyboard, VCR, DVD player, and other audiovisual equipment. Embodiments of the present invention further include a bolt or pin 48 to securely lock each support structure 16 and top wall 14 in place. The outer section 44 of the walls 12 in embodiments of the monitor stand 10 includes, but not limited to a hook and loop material for attaching objects to the stand 10. The monitor stand 10 further includes a plurality of shelves 34 coupled to the outer section 44 of the walls 12 of the stand 10 to accommodate a keyboard for the CPU or other relates items.

Embodiments of the monitor stand 10 include an accessible storage unit 36 for consumer related items secured to the outer section 44 of the walls 12. The monitor stand 10 further includes at least one handle 40 coupled to the outer section 44 of the wall(s) 12 of the stand 10 for portability. Each wall 12 includes at least one aperture 50 dimensioned and configured to accommodate cables and/or plugs. The monitor stand 10 further includes wheels 24 coupled to the bottom 30 of the walls for sliding the stand 10 in assembled form on a floor or like surface. In embodiments of the present monitor stand 10 the wheels 50 are a plurality of permanent or removable casters. The monitor stand 10 includes a lockable rear access door 32 within at least one wall 12 to remove or add items stored in the monitor stand 10. The monitor stand 10 further includes a case (not shown) to accommodate the stand 10 in a collapsible configuration for storage and portability.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A foldable, sturdy, lightweight, multi-walled monitor stand for portability, comprising:

at least three walls, a plurality of support structures, and a top wall, each said wall having a top section, bottom section, inner section, and outer section, wherein said outer section of said walls include a hook and loop material for attaching objects to said stand;

at least three said walls enclosing said plurality of support structures, wherein at least one said wall having an opening for a computer monitor;

at least one handle coupled to said outer section of said wall(s) of said stand for portability;

hinging means for coupling (hinges) each said wall, each said support structure, and said top wall together to form a unitary structure which permits folding between each said wall, each said support structure, and said top wall to form a housing enclosing said support structures, wherein at least two said walls being non-hingedly attached;

first means for securing (brackets) each said support structure and said top wall to a desired position to said inner section of said walls within said housing when said stand is assembled, said first means for securing being coupled to said inner section of said walls; and second means for securing said non-hingedly coupled walls together for complete assemblage of said stand and/or to secure any items within said assembled stand.

2. The monitor stand according to claim 1, wherein said hinging means for coupling each said wall, each said support structure, and said top wall together to form a unitary structure includes single hinge(s) or double hinge(s).

3. The monitor stand according to claim 2, wherein said hinges are double-hinged and/or single hinged.

4. The monitor stand according to claim 1, wherein said first means for securing each said support structure and said top wall to said inner section of said walls includes brackets.

5. The monitor stand according to claim 1, wherein said second means for securing said non-hingedly coupled walls together for complete assemblage of said stand including a locking means coupled to said outer section of said non-hinged walls to secure any items within said assembled stand.

6. The monitor stand according to claim 1, wherein said unitary structure is folded into a collapsible unassembled position for storage and portability.

7. The monitor stand according to claim 1, wherein said walls, said top wall, and said support structures are constructed of rigid sturdy lightweight materials including aluminum, plastic, and aluminum plastic laminate.

8. The monitor stand according to claim 1, further comprising a lockable rear access door within at least one said wall to remove or add items stored in said stand.

9. The monitor stand according to claim 1, wherein said support structures are dimensioned and configured to accommodate the inclusion of at least one of a monitor, interactive touch screen monitor, CPU, keyboard, VCR, DVD player, and other audiovisual equipment.

10. The monitor stand according to claim 1, wherein each said wall, said top wall, and said support structures are constructed of a sturdy lightweight material.

11. The monitor stand according to claim 1, wherein each said wall includes at least one aperture dimensioned and configured to accommodate cables and/or plugs.

12. The monitor stand according to claim 1, further comprising a case to accommodate said stand in a collapsible configuration for storage and portability.

13. The monitor stand according to claim 1, wherein said first means for securing each said support structure and said top wall to a desired position to said inner section of said walls within said housing when said stand is assembled further comprising a bolt or pin to securely lock each support structure and top wall in place.

14. The monitor stand according to claim 1, wherein said further comprising wheels coupled to the bottom of said walls for sliding said stand on a floor or like surface.

15. The monitor stand according to claim 1, further comprising an accessible storage unit secured to said outer section of said walls for consumer related items.

16. The monitor stand according to claim 1, wherein said support structures are foldable shelves.

17. The monitor stand according to claim 1, further comprises a plurality of shelves coupled to said outer section of said walls to accommodate a keyboard for the CPU or other related items.

* * * * *